US008375996B2

(12) United States Patent
Bech

(10) Patent No.: US 8,375,996 B2
(45) Date of Patent: Feb. 19, 2013

(54) METHOD AND AN APPARATUS FOR PRODUCING A MULTIAXIAL FABRIC

(75) Inventor: Anton Bech, Ringkobing (DK)

(73) Assignee: Vestas Wind Systems A/S, Aarhus N (DK)

( * ) Notice: Subject to any disclaimer, the term of this patent is extended or adjusted under 35 U.S.C. 154(b) by 133 days.

(21) Appl. No.: 13/126,908

(22) PCT Filed: Oct. 30, 2009

(86) PCT No.: PCT/EP2009/064361

§ 371 (c)(1),
(2), (4) Date: Apr. 29, 2011

(87) PCT Pub. No.: WO2010/052171

PCT Pub. Date: May 14, 2010

(65) Prior Publication Data

US 2011/0209795 A1 Sep. 1, 2011

Related U.S. Application Data

(60) Provisional application No. 61/121,053, filed on Dec. 9, 2008, provisional application No. 61/198,471, filed on Nov. 5, 2008.

(30) Foreign Application Priority Data

Nov. 5, 2008 (DK) ..... 2008 01522
Dec. 9, 2008 (DK) ..... 2008 01741

(51) Int. Cl.
*D03D 25/00* (2006.01)
*D03D 41/00* (2006.01)

(52) U.S. Cl. ..... 139/383 R; 139/11; 139/DIG. 1; 139/DIG. 001

(58) Field of Classification Search ..... 139/11, 139/408–415, DIG. 1
See application file for complete search history.

(56) References Cited

U.S. PATENT DOCUMENTS 1,368,215 A * 2/1921 Stewart ..... 139/419
1,941,121 A * 12/1933 Straeten, V ..... 174/117 M
(Continued)

FOREIGN PATENT DOCUMENTS

DE 10 2007 007 919 2/2008
EP 0 768 167 4/1997
(Continued)

OTHER PUBLICATIONS

Jens Skou; 1st Technical Examination Report and Search Report issued in priority Denmark Application No. PA 2008 01522; Jun. 21, 2009; 3 pages; Denmark Patent and Trademark Office.

(Continued)

*Primary Examiner* — Bobby Muromoto, Jr.
(74) *Attorney, Agent, or Firm* — Wood, Herron & Evans, LLP

(57) ABSTRACT

At least one yarn is arranged helically about at least two conveyor portions, thereby providing a weft having a first weft portion having yarns arranged at an angle, θ, with respect to the conveying direction of the conveyor portions, and a second weft portion having yarns arranged at an angle, −θ, with respect to the conveying direction of the conveyor portions. Center sections of the first weft portion and the second weft portion are then fixated to each other, e.g. by stitching and/or by applying a resin to the center sections. Side portions of the weft are then cut, thereby separating the first weft portion from the second weft portion. Finally, rim sections of the first weft portion are fixated to rim sections of the second weft portion, e.g. by stitching and/or by applying a resin to the rim sections.

20 Claims, 8 Drawing Sheets

U.S. PATENT DOCUMENTS

| | | | | |
|---|---|---|---|---|
| 3,041,230 | A | 6/1962 | Diehl | |
| 3,537,937 | A * | 11/1970 | Medney | 156/426 |
| 4,265,691 | A | 5/1981 | Usui | |
| 5,242,768 | A * | 9/1993 | Nagatsuka et al. | 429/127 |
| 5,305,504 | A | 4/1994 | Manly, Jr. | |
| 6,431,222 | B1 * | 8/2002 | Khokar | 139/383 R |
| 6,913,045 | B2 * | 7/2005 | Fantino et al. | 139/11 |
| 7,877,935 | B2 * | 2/2011 | Ollgaard | 52/40 |
| 8,047,798 | B2 * | 11/2011 | Bech | 416/230 |
| 2009/0035517 | A1 * | 2/2009 | Bech | 428/138 |
| 2010/0310380 | A1 * | 12/2010 | Bech | 416/230 |

FOREIGN PATENT DOCUMENTS

| | | |
|---|---|---|
| EP | 1 586 688 | 10/2005 |
| EP | 1 693 496 | 8/2006 |
| WO | 2008/014784 | 2/2008 |
| WO | 2009/024113 | 2/2009 |

OTHER PUBLICATIONS

Stephane Demay; International Search Report and Written Opinion issued in priority International Application No. PCT/EP2009/064361; Jan. 27, 2010; 14 pages; European Patent Office.

Stephane Demay; International Preliminary Report on Patentability issued in priority International Application No. PCT/EP2009/064361; Feb. 4, 2011; 13 pages; European Patent Office.

* cited by examiner

METHOD AND AN APPARATUS FOR PRODUCING A MULTIAXIAL FABRIC

FIELD OF THE INVENTION

The present invention relates to a method and an apparatus for producing a multiaxial fabric, e.g. wefts of fibre glass. The method and apparatus of the invention ensure that the utilisation of the material used for making the multiaxial fabric is maximised.

BACKGROUND OF THE INVENTION

Multiaxial fabrics have previously been manufactured by arranging weft layers of yarns or fabric web relatively to each other in such a manner that axes defined by the layers are arranged with desired angles there between. In some prior art methods and apparatuses this is obtained by moving one or more yarn spools back and forth along a transverse direction of a moving conveyor. In other prior art methods and apparatuses weft layers are applied helically about a moving conveyor, e.g. by performing relative rotational movements of one or more yarn spools and the conveyor.

Subsequently the weft layers are fixated relative to each other, thereby forming a multiaxial fabric.

DESCRIPTION OF THE INVENTION

It is an object of embodiments of the invention to provide a method for producing a multiaxial fabric in which the utilisation of the used material is improved as compared to prior art methods.

It is a further object of embodiments of the invention to provide a method for producing a multiaxial fabric in which the manufacturing costs can be reduced as compared to prior art methods.

It is an even further object of embodiments of the invention to provide an apparatus for producing a multiaxial fabric which allows the utilisation of the used material to be improved as compared to prior art apparatuses.

It is an even further object of embodiments of the invention to provide an apparatus for producing a multiaxial fabric which allows the manufacturing costs to be reduced as compared to prior art apparatuses.

According a first aspect the invention provides a method for producing a multiaxial fabric, the method comprising the steps of:

- arranging at least one yarn helically about at least two conveyor portions, thereby providing a weft having a first weft portion having yarns arranged at an angle, θ, with respect to the conveying direction of the conveyor portions, and a second weft portion having yarns arranged at an angle, −θ, with respect to the conveying direction of the conveyor portions,
- fixing a centre section of the first weft portion to a centre section of the second weft portion,
- cutting side portions of the weft, thereby separating the first weft portion from the second weft portion, and
- fixing rim sections of the first weft portion to rim sections of the second weft portion.

In the present context the term 'multiaxial fabric' should be interpreted to mean a fabric providing a specified strength in multiple directions, such as a warp knitted material. The multiaxial fabric may comprise one or more layers of long fibres, e.g. in the form of yarns. The layers may be fixed relative to each other, either mechanically, e.g. by stitching, or by means of a substance, such as an adhesive, glue or resin.

Multiaxial fabrics are appropriate for use under conditions of multiaxial loads, such as for fibre glass material, e.g. for wind turbine rotor blades.

At least one yarn is arranged helically about at least two conveyor portions. In the present context the term 'yarn' should be interpreted to mean a long continuous length of interlocked fibres. It may be in the form of a thread, or it may be a flat band-like structure. Each of the yarn(s) describes a helix, i.e. it is wound continuously about the conveyor portions for several revolutions while displacing the conveyor portions and the source of the yarn, e.g. one or more yarn spools, relatively to each other in order to ensure that one yarn revolution is not arranged directly onto a previous yarn revolution.

The conveyor portions may be or form part of endless conveyors, such as belt conveyors or chain conveyors. In the case that the at least one yarn is/are arranged helically about exactly two conveyor portions, the two conveyor portions may be arranged with a distance there between which is significantly larger than a 'height' defined by each of the conveyor portions. In this case, when winding a yarn helically about the conveyor portions, the resulting weft defines two substantially planar portions arranged opposite each other in the region between the two conveyor portions. The two substantially planar portions are interconnected at the positions of the two conveyor portions, since a single yarn is wound continuously about the conveyors for several revolutions, i.e. the two planar portions are made from the same yarn(s).

In the case that the at least one yarn is/are arranged helically about three or more conveyor portions, the shape of the resulting weft may differ from the shape described above.

In any case, arranging at least one yarn helically about the at least two conveyor portions results in a weft having a first weft portion and a second weft portion. The first and second weft portions may advantageously be the two oppositely arranged substantially planar portions in the embodiment described above. Since the yarn(s) is/are arranged helically, if the yarns of one of the substantially planar weft portions is arranged at an angle, θ, with respect to the conveying direction of the conveyor portions, then the yarns of the other of the substantially planar weft portions will automatically be arranged at an angle, −θ, with respect to the conveying direction of the conveyor portions. Thus, the helical arrangement of the yarn(s) automatically ensures a ±θ arrangement of the first weft portion and the second weft portion. The angle, θ, may be within the interval 10° to 90°, such as within the interval 30° to 85°, such as within the interval 45° to 80°, such as approximately 80°.

It is an advantage that the yarns are arranged helically about the conveyors, because it allows flat high tex yarn, e.g. 4800 tex yarn, to be used in order to provide a low area weight of the weft. Such high tex yarn is cheaper than the normally used low tex yarn, e.g. 600 tex yarn, and the manufacturing costs are thereby reduced as compared to prior art methods.

When the weft has been provided as described above, a centre section of the first weft portion is fixated to a centre section of the second weft portion. This is preferably done while the weft is still held by the conveyor sections. Thereby a laminate is formed from the centre sections of the weft portions, and the two centre sections are kept together at least to the extent that they are allowed to be handled as a single piece. For instance, the centre sections may be only partially fixed or attached to each other, e.g. only in certain points or along certain lines. This may, e.g., be obtained by stitching the centre portions together along substantially parallel lines or applying resin in points or along certain lines. In this case the centre sections may be allowed to perform limited relative movements along the parts which are not fixed or attached to each other, but the first weft portion as such is not allowed to perform relative movements with respect to the second weft portion as such, thereby allowing the weft portions to be handled as a single piece. As an alternative, the centre sections of the weft portions may be completely attached or fixed to each other.

The centre section of a weft portion may advantageously be a section of the weft portion which is arranged between two conveyor portions. Thus, in the case that the at least one yarn is/are wound about exactly two conveyor portions, as described above, the sections of the weft portions being arranged between the conveyor portions and opposite each other may be fixed to each other. However, the part of the weft arranged at or near the conveyor portions is not fixed to anything during this step.

Subsequently, side portions of the weft are cut. The side portions may advantageously be the part of the weft which is arranged at or near the conveyor portions, e.g. the part of the weft which is in direct contact with the conveyor portions. Thereby the first weft portion is separated from the second weft portion, and two separate weft layers are formed, though the weft layers are fixed to each other at their centre sections.

Subsequently, rim sections of the first weft portion are fixed to rim sections of the second weft portion. Thereby the remaining parts of the weft portions are fixed to each other, i.e. a laminate in which the entire surface of at least one of the weft layers is fixed to another weft layer is formed.

The sequence of fixing the centre sections of the weft portions to each other, cutting the side portions of the weft, and fixing the rim sections of the weft portions together, is an advantage because it allows all of the material used for making the weft to be used in the resulting laminate. Thus, it is not necessary to cut away the sides of the weft layers. Accordingly, a minimal amount of material is wasted and manufacturing costs are reduced.

The step of arranging at least one yarn may comprise simultaneously arranging at least two yarns helically about the at least two conveyor portions. According to this embodiment the weft can be made relatively quickly, and the yarns can be arranged closely together in the weft.

The step of arranging at least one yarn may comprise rotating a yarn spool holder carrying at least one yarn spool about the conveyor portions. The combined relative movement resulting from a linear movement of the conveyor portions and the rotational movement of the yarn spool holder automatically ensures that the yarns are arranged helically about the conveyor portions. As an alternative, the yarn spool holder may be kept immovable, while the conveyor portions are rotated.

The step of fixing a centre section of the first weft portion to a centre section of the second weft portion may comprise the step of stitching the centre section together.

Similarly, the step of fixing rim sections of the first weft portion to rim sections of the second weft portion may comprise the step of stitching the rim sections together. As an alternative, one or both of the fixing steps may be performed by means of bonding or gluing.

Alternatively or additionally, the step of fixing a centre section of the first weft portion to a centre section of the second weft portion comprises the steps of:

applying resin onto a centre section of the first weft portion and/or onto a centre section of the second weft portion, and pressing the centre section of the first weft portion and the centre section of the second weft portion towards each other.

Similarly, the step of fixing the rim sections of the first weft portion to rim sections of the second weft portion comprises the steps of:

applying resin onto rim sections of the first weft portion and/or onto rim sections of the second weft portion, and pressing the rim sections of the first weft portion and the rim sections of the second weft portion towards each other.

According to these embodiments, a preform moulding material may advantageously be manufactured by the method. In the present context the term 'preform moulding material' should be interpreted to mean a material which is at least partly preimpregnated with a resin. The preform moulding material may advantageously be a composite material comprising fibres or yarns and an uncured resin.

The preform moulding material may subsequently be formed into a desired three-dimensional shape, e.g. a composite structure, such as a turbine blade for a wind turbine or part of a turbine blade for a wind turbine.

According to this embodiment, when the weft has been provided as described above, resin is applied onto a centre section of the first weft portion and/or onto a centre section of the second weft portion. Resin may be applied onto a centre section of only one of the weft portion, or it may be applied onto centre sections of both weft portions. The resin may be applied onto a surface of a weft portion which faces the other weft portion and/or it may be applied onto a surface facing away from the other weft portion. Applying the resin onto one or both centre sections may result in the centre section(s) being at least partly impregnated substantially immediately. This may, e.g., be the case if the resin is sufficiently liquid to allow it to permeate into the weft portion(s), e.g. due to gravity or by capillary forces.

When resin has been applied onto centre section(s) of the weft portion(s), the centre section of the first weft portion and the centre section of the second weft portion are pressed towards each other. The resin applied onto one or both of the centre sections of the weft portions will thereby cause the centre sections of the first and second weft portions to stick to each other, thereby fixating the mutual position of the weft portions. Thus, according to this embodiment, it is not required to stitch the weft portions together, or to fixate them relative to each other in any other way. This is an advantage, because the stitching material can be dispensed with, and the costs involved therein are therefore saved. Furthermore, a process step can be left out of the manufacturing method. However, the present invention also covers embodiments where the fixing steps include applying a resin as well as stitching.

The resin may be any kind of resin which is suitable for use in prepregs. The resin is preferably capable of fixing the weft layers relative to each other. For instance, the resin may be heated prior to the application, thereby allowing the resin to be applied while in a substantially liquid form. Subsequently, when the weft layers are pressed towards each other, the resin cools, thereby becoming solid or semisolid and fixing the weft layers relative to each other. The resin may be, e.g., a semisolid epoxy resin containing a curing agent.

The resin applying step and the pressing step may advantageously be performed while the weft is still held by the conveyor sections. Thereby a laminate is formed from the centre sections of the weft portions, and the two centre sections are kept firmly together in the sense that they are not allowed to move relative to each other. The centre section of a weft portion may advantageously be a section of the weft portion which is arranged between two conveyor portions. Thus, in the case that the at least one yarn is/are wound about exactly two conveyor portions, as described above, the sections of the weft portions being arranged between the conveyor portions and opposite each other may have resin applied thereto and be pressed towards each other. However, the part of the weft arranged at or near the conveyor portions is left unaffected during these steps.

After the cutting step, resin may be applied onto rim sections of the first weft portion and/or onto rim sections of the second weft portion, and the rim sections may be pressed towards each other. Similarly to what is described above, the resin may be applied onto rim sections of only one of the weft portion, or it may be applied to rim sections of both of the weft portions. The remarks set forth above regarding application of resin are equally applicable here. During these steps, the remaining parts of the weft portions are fixed to each other, i.e. a laminate in which substantially the entire surface of at least one of the weft portions is fixed to another weft portion is formed. It should be noted that the step of fixing the rim sections could result in the rim sections being fixed relative to each other completely to the edge of at least one of the rim sections of at least one of the weft portions. As an alternative, the rim sections may be fixed relative to each other along a significant part of the rim portions, e.g. leaving a minor portion of the rim sections close to the edge non-fixed. In any event, the rim sections should be fixed to an extent which is sufficient to ensure that the edges of the weft portions are controllable.

It is an advantage of this embodiment that resin is applied onto one or both of the weft portions during manufacturing of the multiaxial fabric, because the preform moulding material or prepreg is thereby manufactured in one handling step, i.e. it is not necessary to first produce a multiaxial fabric using one machine, and subsequently apply resin to the multiaxial fabric, e.g. using a second machine. Rather, in the method of this embodiment of the invention, the preform moulding material is manufactured directly from the yarn and the resin in one handling step, i.e. the manufacture is a continuous process performed in one machine. This minimises the handling of the product.

The step of applying resin onto centre section(s) of the first and/or second weft portions and/or the step of applying resin onto rim sections of the first and/or second weft portions may be performed by means of an extrusion process. According to this embodiment, the resin is supplied directly from the resin pump to the site of application. However, other processes for applying the resin could alternatively be envisaged.

Alternatively or additionally, the step of applying resin onto centre section(s) of the first and/or second weft portions and/or the step of applying resin onto rim sections of the first and/or second weft portions may be performed by applying the resin as a plurality of beads. According to this embodiment, a semi-impregnated material is provided. The resulting preform moulding material is, in this case, relatively permeable to gases which need to escape from the material during vacuum evacuation.

Alternative or additionally, the step of applying resin onto centre section(s) of the first and/or second weft portions and/or the step of applying resin onto rim sections of the first and/or second weft portions may be performed by applying the resin as a substantially continuous resin layer. According to this embodiment, a fully impregnated material is provided, i.e. the entire material is wetted by the resin.

It should be noted that all of the resin may be applied as a plurality of beads, or all of the resin may be applied as a substantially continuous resin layer, or some of the resin may be applied as a plurality of beads while some of the resin is applied as a substantially continuous resin layer.

The step of applying resin onto a centre section of the first weft portion and/or onto a centre section of the second weft portion may comprise applying resin in a region between the centre section of the first weft portion and the centre section of the second weft portion. According to this embodiment, the resin is applied between the centre sections of the weft portions. Thus, the applied resin may come into contact with both of the centre sections of the weft portions, either immediately upon applying the resin or when the centre sections are pressed towards each other.

Alternatively or additionally, resin may be applied to surfaces of the centre sections of one or both of the weft portions which face away from the other weft portion. Resin applied in this manner may only come into contact with the weft portion onto which it is applied. According to this embodiment, the resin may not in itself be capable of fixing the weft layers relative to each other, and other measures, such as partial or full heating of the resin, causing a partial or full impregnation of both layers, may be required.

Similarly, the step of applying resin onto rim sections of the first weft portion and/or onto rim sections of the second weft portion may comprise applying resin in regions between rim sections of the first weft portion and rim sections of the second weft portion. As described above, the resin may thereby come into contact with both of the weft portions, either immediately upon applying the resin or when the rim sections are pressed towards each other.

Alternatively or additionally, resin may be applied to surfaces of the rim sections of one or both of the weft portions which face away from the other weft portion. Resin applied in this manner may only come into contact with the weft portion onto which it is applied.

The step of applying resin onto the rim sections of the first weft portion and/or onto rim sections of the second weft portion may be performed substantially simultaneously with the step of applying resin onto a centre section of the first weft portion and/or onto a centre section of the second weft portion. According to this embodiment, the resin may be applied to the centre section(s) and the rim sections in one step and using the same resin applying unit. The resin applying unit used for applying resin onto the centre section(s) of the first and/or second weft portions may, e.g., be capable of applying sufficient resin to allow some of the resin to enter the rim sections. Thus, resin is already present at the rim sections during the cutting step, and it is only necessary to press the rim sections towards each other after the cutting step in order to fixate the rim sections of the first and second weft portions. The step of pressing the centre sections of the first and second weft portions towards each other and/or the step of pressing the rim sections of the first and second weft portions towards each other may be performed by means of at least one double belt press. Alternatively one or both of these steps may be performed by means of rollers arranged to press the relevant parts of the weft portions towards each other.

The step of cutting side portions of the weft may be performed by means of rotating cutting means, e.g. a rotating saw. Alternatively, any other suitable cutting methods may be used, including cutting linearly or applying heat to the yarns of the weft.

The step of cutting side portions of the weft may be performed in such a manner that the separated first and second weft portions obtain substantially equal width. According to this embodiment, the weft may advantageously be cut at a position which is substantially halfway between a level defined by the first weft portion and a level defined by the second weft portion. Thereby edges of the first weft portion are arranged substantially corresponding to edges of the second weft portion. This may, e.g., be obtained by cutting the side portions of the weft along a substantially horizontal direction.

Alternatively, the step of cutting side portions of the weft may be performed in such a manner that the first weft portion obtains a width which is smaller than a width obtained by the second weft portion, or in such a manner that the second weft portion obtains a width which is smaller than a width of the first weft portion. According to this embodiment, the edges of the first weft portion and the edges of the second weft portion are arranged shifted or staggered relative to each other. This may, e.g., be obtained by cutting the side portions of the weft at a position which is closer to a level defined by the first weft portion than to a level defined by the second weft portion, or vice versa. In this case the cutting may be performed along an inclined direction. One advantage of this embodiment is that only one weft layer is present at the side edges of the weft, while a double layer is present at the centre portion of the weft. Thereby a smoother edge of the weft is obtained, hence the stress concentration at the edge of the weft is reduced.

As another alternative, the side portions of the weft may be cut in such a manner that the edges of the first weft portion are arranged shifted or staggered relative to the edges of the second weft portion, while the weft portions have substantially equal width. This may, e.g., be obtained by cutting one side portion of the weft at a position which is closer to a level defined by the first weft portion than to a level defined by the second weft portion, and cutting the other side portion of the weft at a position which is closer to a level defined by the second weft portion than to a level defined by the first weft portion. Thereby the first weft portion extends further in a sideways direction than the second weft portion at one side of the weft, and the second weft portion extends further in a sideways direction than the first weft portion at an opposite side of the weft. Thus, similarly to the embodiment described above, only one weft layer is present at the side edges of the weft, and a smoother edge of the weft is obtained, hence the stress concentration at the edge of the weft is reduced.

The method may further comprise the step of arranging at least one additional yarn substantially along the conveying direction of the conveyor portions, thereby providing at least one warp portion. According to this embodiment the multiaxial fabric comprises layer defining at least three different directions, i.e. $\pm\theta$ and 0° with respect to the conveying direction of the conveyor portions.

The warp portion(s) may be arranged between the first weft portion and the second weft portion. In this case the additional yarn may, e.g., be supplied from a set of yarn spools arranged within a perimeter defined by a rotating yarn spool holder carrying the yarn spool(s) used for supplying yarn to the first and second weft portions.

Alternatively or additionally, one or more warp portions may be arranged adjacent to a surface of the first weft portion facing away from the second weft portion and/or adjacent to a surface of the second weft portion facing away from the first weft portion. In this case the additional yarn may, e.g., be supplied from a set of yarn spools arranged above or below the conveyor portions.

According to a second aspect the invention provides an apparatus for producing a multiaxial fabric, the apparatus comprising:

at least two conveyor portions defining a conveying direction, at least one yarn spool adapted to supply yarn helically about said conveyor portions, in order to provide a weft having a first weft portion having yarns arranged at an angle, $\theta$, with respect to the conveying direction of the conveyor portions, and a second weft portion having yarns arranged at an angle, $-\theta$, with respect to the conveying direction of the conveyor portions, a first fixing unit arranged to fixate a centre section of the first weft portion to a centre section of the second weft portion, at least one cutting unit arranged to cut side portions of the weft in order to separate the first weft portion from the second weft portion, and at least one additional fixing unit arranged to fixate rim sections of the first weft portion to rim sections of the second weft portion.

It should be noted that a person skilled in the art would readily recognise that any feature described in combination with the first aspect of the invention could also be combined with the second aspect of the invention, and vice versa.

The apparatus according to the second aspect of the invention is suitable for, and may advantageously be used for, performing the method according to the first aspect of the invention. Thus, when the at least one yarn spool supplies yarn helically about the conveyors, a first and a second weft portion are provided as described above. The centre sections of the first and second weft portions are fixed to each other by means of the first fixing unit. The side portions of the weft are cut by means of the cutting unit(s), thereby separating the first weft portion from the second weft portion and forming two weft layers. Finally, the rim sections of the first weft portion are fixed to rim sections of the second weft portion by means of the additional fixing unit(s).

The yarn spool(s), the first fixing unit, the cutting unit(s) and the additional fixing unit(s) are preferably arranged along the conveying direction of the conveyor portions in such a manner that, from an upstream towards a downstream position, the yarn spool(s) is/are first encountered, then the first fixing unit, the cutting unit(s) and finally the additional fixing unit(s). Thus, when the weft is moved along with the conveyor portion(s), the yarn(s) is/are initially wound about the conveyor portions, then the centre portions of the weft layers are fixed relative to each other. Subsequently, the side portions of the weft are cut, and finally the rim portions of the weft layers are fixed to each other.

The apparatus may comprise two or more additional fixing units. In this case one fixing unit may be arranged at a position corresponding to one of the cut side portions, and one fixing unit may be arranged at a position corresponding to an opposite cut side portion. Thereby the first additional fixing unit may be used for fixating one set of rim sections to each other, while the second additional fixing unit is used for fixating another, oppositely arranged, set of rim sections to each other. The additional fixing units may be arranged in such a manner that the two sets of rim sections are fixated to each other substantially simultaneously.

The apparatus may comprise at least two yarn spools adapted to simultaneously supply yarn helically about said conveyor portions. According to this embodiment the apparatus is adapted to simultaneously arrange at least two yarns helically about the at least two conveyor portions. Thereby the weft can be made relatively quickly, and the yarns can be arranged closely together in the weft.

The yarn spool(s) may be mounted on a spool holder, and the spool holder and the conveyor portions may be adapted to perform relative rotational movements. This may, e.g., be obtained by mounting the spool holder in a rotational manner, thereby allowing it to rotate about the conveyor portions, the conveyor portions being mounted non-rotationally. As an alternative, the conveyor portions may be mounted in a rotational manner, while the spool holder is mounted substantially non-rotationally. As another alternative, the conveyor portions as well as the spool holder may be allowed to perform rotational movements, as long as the rotational movements of the conveyor portions and the spool holder results in a relative rotational movement.

As described above, the relative rotational movement between the yarn spool holder and the conveyor portion(s) combined with a linear movement of the conveyor portions along the conveying direction automatically results in the yarn(s) being arranged helically about the conveyor portions.

The first fixing unit and/or the additional fixing unit(s) may comprise one or more stitching units. According to this embodiment, the centre section and/or the rim sections of the first and second weft portions are stitched together. As an alternative, the first fixing unit and/or one or more of the additional fixing unit(s) may be adapted to fixate the weft portions to each other by other means, such as bonding or gluing.

Alternatively or additionally, the first fixing unit and/or the additional fixing unit(s) may comprise one or more resin applying units and one or more pressing units. According to this embodiment, resin is applied onto the centre section(s) of the first and/or second weft portions by means of a first resin applying unit. The centre sections of the first and second weft portions are pressed towards each other by means of a first pressing unit. After the cutting step, resin is applied onto the rim sections of the first and/or second weft portions by means of one or more additional resin applying units. Finally, the rim sections of the first and second weft portions are pressed towards each other by means of one or more additional pressing units.

The apparatus may comprise two or more additional resin applying units and two or more additional pressing units. In this case one pair of resin applying unit and pressing unit may be arranged at a position corresponding to one of the cut side portions, and one pair of resin applying unit and pressing unit may be arranged at a position corresponding to an opposite cut side portion. Thereby the first pair of additional resin applying unit and pressing unit may be used for fixating one set of rim sections to each other, while the second pair of additional resin applying unit and pressing unit is used for fixating another, oppositely arranged, set of rim sections to each other. The additional resin applying units and pressing units may be arranged in such a manner that the two sets of rim sections are fixated to each other substantially simultaneously.

The first resin applying unit and/or the additional resin applying unit(s) may comprise at least one resin extrusion head. According to this embodiment, at least some of the resin is applied by means of an extrusion process.

Alternatively of additionally, the first resin applying unit and/or the additional resin applying unit(s) may be adapted to apply resin as a plurality of beads and/or the first resin applying unit and/or the additional resin applying unit(s) may be adapted to apply resin as a substantially continuous resin layer.

The first resin applying unit may be adapted to apply resin in a region between the centre section of the first weft portion and the centre section of the second weft portion. As described above, the applied resin may thereby be allowed to come into contact with both of the weft portions. Alternatively or additionally, the first resin applying unit may be adapted to apply resin onto a surface of one or both of the centre sections of the weft portions, which faces away from the other weft portion.

Similarly, at least one of the additional resin applying unit(s) may be adapted to apply resin in a region between a rim section of the first weft portion and a rim section of the second weft portion. In this case the applied resin may be allowed to come into contact with both of the weft portions.

The first pressing unit and/or the additional pressing unit(s) may comprise at least one double belt press. As an alternative, some or all of the pressing units may comprise rollers arranged to press the relevant parts of the weft portions towards each other.

The conveyor portions may be or form part of chain conveyors. Each chain section of the conveyor portions may, in this case, comprise a chain head being provided with a groove being adapted to receive a cutting tool. According to this embodiment, side portions of the weft can be cut while the weft is still arranged on the conveyor portions, and the side portions can be cut in a region which abuts a conveyor portion. Thereby the cutting of the side portions of the weft may cause the weft to be released from the conveyor portions. The position and spatial orientation of the groove determines the position and direction of the cut performed by the cutting unit(s). Thus, in the case that the groove is arranged substantially horizontally at a position substantially halfway between a level defined by the first weft portion and a level defined by the second weft portion, the separated weft portions obtain substantially the same width, and the edges of the first weft layer will be arranged substantially corresponding to the edges of the second weft layer. If, on the other hand, the groove is arranged along an inclined direction and closer to a level defined by the first/second weft layer than to a level defined by the second/first weft layer, the first weft layer and the second weft layer will not obtain the same width, or the first and second weft layer will be arranged shifted or staggered relative to each other. Accordingly, the edges of the resulting weft only comprises a single weft layer, thereby providing smoother edges of the weft, hence reducing the stress concentration at the edge of the weft.

As an alternative, the side portions of the weft may be cut at a positioned next to the chain head. In this case collision between the cutting means and the chain head is also avoided. Furthermore, the shifted or staggered arrangement of the weft layers is also obtained in this case, i.e. the advantages described above are also obtained.

The conveyor portions may be provided with serrated edges. The serrated edges 'catch' the yarn being arranged helically about the conveyor portions, thereby preventing the yarn from skidding. Thus, the yarn is kept in the original and intended position, thereby ensuring an intended orientation of the yarn when the weft reaches the first fixing unit.

BRIEF DESCRIPTION OF THE DRAWINGS

The invention will now be described in further detail with reference to the accompanying drawings in which.

DETAILED DESCRIPTION OF THE DRAWINGS

Figure 1:
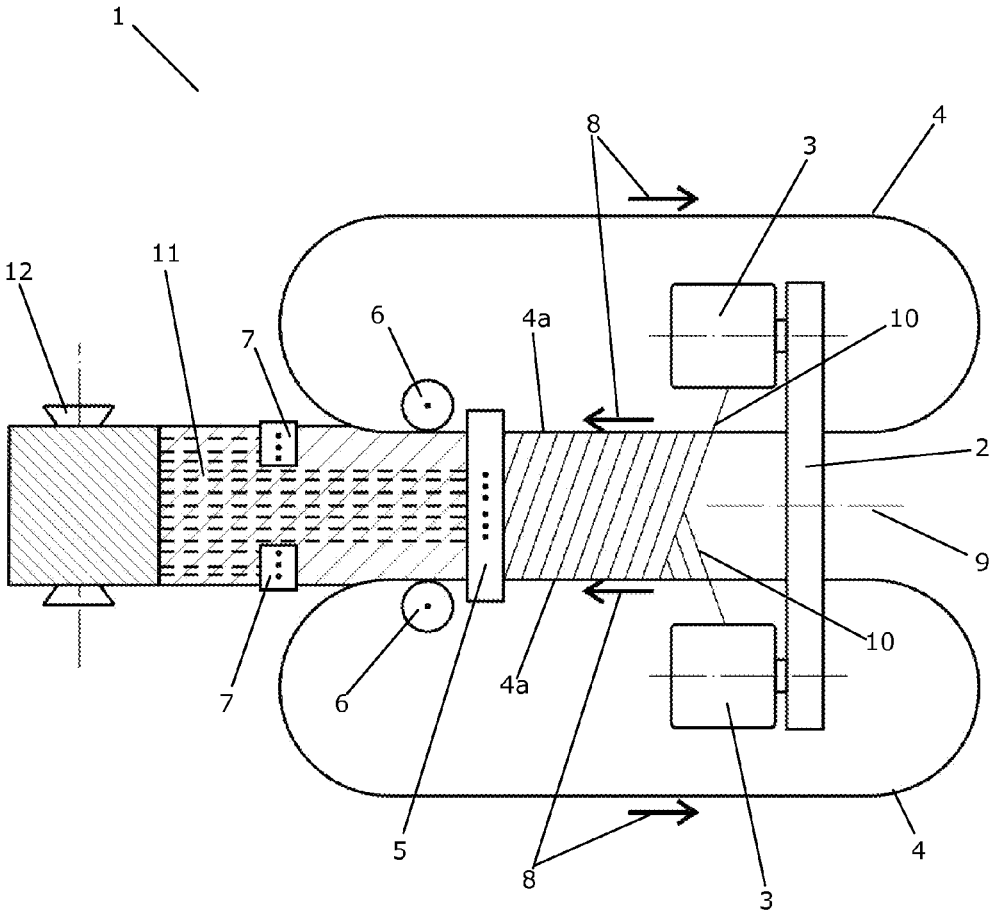
FIG. 1 is a schematic view from above of an apparatus according to a first embodiment of the invention.

FIG. 1 is a schematic view from above of an apparatus 1 according to a first embodiment of the invention. The apparatus 1 comprises a yarn spool holder 2 carrying a number of yarn spools 3, two of which are visible. The yarn spool holder 2 is arranged in such a manner that it is capable of rotating about substantially parallelly arranged portions 4*a* of two endless conveyors 4.

The apparatus 1 further comprises a first stitching unit 5, two cutting units 6 and two additional stitching units 7.

The conveyors 4 are movable along a conveying direction indicated by arrows 8. When the yarn spool holder 2 is rotated about rotational axis 9 and the conveyors 4 are simultaneously moved along the conveying direction 8, yarn 10 from the yarn spools 3 is arranged helically about the conveyor portions 4*a*. The pitch of the helix defined by each yarn 10 is determined by the rotational speed of the yarn spool holder 2 and the conveying speed of the conveyors 4. Yarn 10 arranged on the upper side of the apparatus 1 is arranged at an angle, θ, with respect to the conveying direction 8, and yarn 10 arranged on the lower side of the apparatus 1 is arranged at an angle, −θ, with respect to the conveying direction 8. The angle, θ, is determined by the pitch of the helix and thereby by the rotating speed of the yarn spool holder 2 and the conveying speed of the conveyors 4.

Thus, the yarn 10 is arranged about the conveyor portions 4*a* in such a manner that a weft 11 is formed, the weft 11 having a first, upper, weft portion having yarns 10 arranged at an angle, θ, with respect to the conveying direction 8, and a second, lower, weft portion having yarns 10 arranged at an angle, −θ, with respect to the conveying direction 8.

The weft 11 is advanced along the conveying direction 8 by the conveyors 4 towards the first stitching unit 5. The first stitching unit 5 stitches the first weft portion and the second weft portion together at a centre section. Thereby the first weft portion and the second weft portion are fixated relative to each other.

The partly stitched weft 11 is advanced further along the conveying direction 8 towards the cutting units 6. The cutting units 6 cut side portions of the weft 11, thereby separating the first weft portion from the second weft portion and forming two weft layers. It should, however, be noted that the two weft layers thereby formed are already fixated relative to each other at the centre section due to the stitching previously performed by the first stitching unit 5.

The cutting of the side portions of the weft 11 further releases the weft 11 from the conveyor portions 4*a*, and the conveyor paths are therefore allowed to return to the position where yarn 10 is being arranged about the conveyor portions 4*a*.

The weft 11 is advanced even further along the conveying direction 8 towards the additional stitching units 7. Each of the additional stitching units 7 stitches a rim section of the first weft portion to a corresponding rim section of the second weft portion. Thereby the weft portions are stitched together in the entire width of the weft 11.

Finally, the finished weft 11 is wound onto web winder 12.

It is noted that since the weft 11 is first stitched in a centre section, then cut at the side portions and finally stitched in the rim sections, no material needs to be cut away from the weft 11. Thereby the material used for making the weft 11 is utilised to the greatest possible extent.

Figure 2:
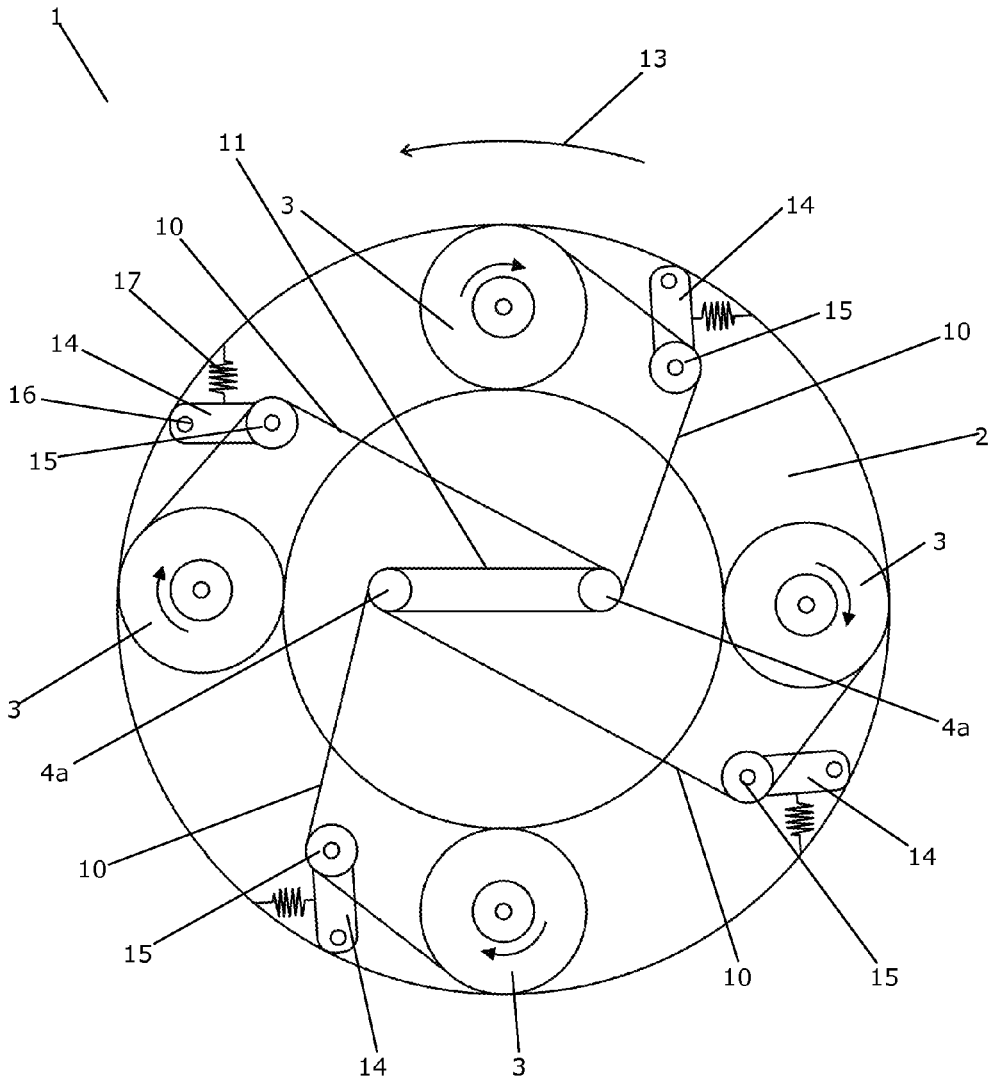
FIG. 2 is an end view of the apparatus of FIG. 1, FIGS. 3-7 are cross sectional views of the apparatus of FIG. 1, at various positions along a conveying direction, and illustrating a method according to a first embodiment of the invention.

FIG. 2 is an end view of the apparatus 1 of FIG. 1. It can be seen that the yarn spool holder 2 carries four yarn spools 3, and that each of the yarn spools 3 wind yarn 10 about the conveyor sections 4*a* to form the weft 11. Arrow 13 indicates that the yarn spool holder 2 is capable of performing rotating movements relative to the conveyor portions 4*a*.

The yarn spool holder 2 further carries four speed and tension compensators 14. Each speed and tension compensator 14 is arranged adjacent to a corresponding yarn spool 3 in such a manner that yarn 10 from a given yarn spool 3 is arranged around a wheel 15 of a corresponding speed and tension compensator 14. The speed and tension compensators 14 are connected to the yarn spool holder 2 via a pivot 16 and a spring 17.

Since the weft 11 is arranged in a manner which is not rotationally symmetrical, the tension of the yarn 10 being wound onto the conveyor portions 4*a* varies as a function of angular position of the yarn spool 3. If these variations in tension are not compensated, the yarn 10 will be applied with varying tension, and this will lead to a non-uniform weft 11. However, the speed and tension compensators 14 compensate for the variation in tension, since the spring force of the spring 17 will increase the tension of the yarn 10 at angular positions where the tension would otherwise be too low. Accordingly, the tension in the part of the yarn 10 which is supplied to the conveyor portions 4*a* is kept substantially constant as the yarn spool holder 2 is rotated, and a substantially uniform weft 11 is obtained.

FIGS. 3-7 are cross sectional views of the apparatus 1 of FIG. 1 taken at various positions along the conveying direction 8. FIGS. 3-7 illustrate various method step of a method for producing a multiaxial fabric according to a first embodiment of the invention, the steps being performed at various positions along the conveying direction 8 as described above with reference to FIG. 1.

Figure 3:
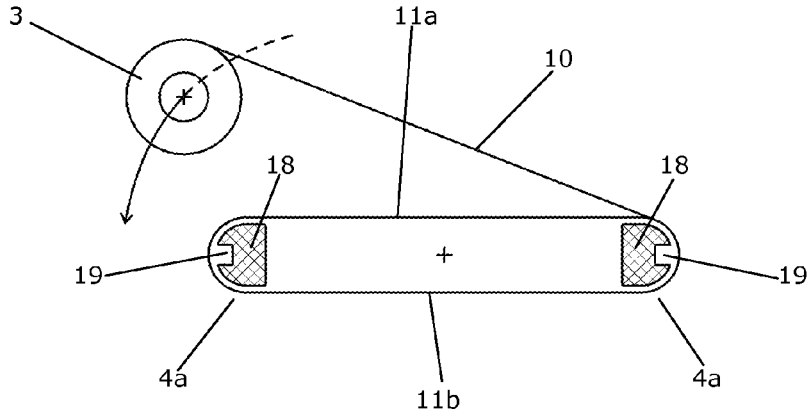

FIG. 3 illustrates the step of arranging a yarn 10 helically about two conveyor portions 4*a* by rotating a yarn spool 3 about the two conveyor portions 4*a*, thereby forming an upper weft portion 11*a* and a lower weft portion 11*b*. In FIG. 3 the conveyor portions 4*a* form part of a chain conveyor comprising a plurality of chain heads 18. Each of the chain heads 18 is provided with a groove 19 adapted to receive a cutting tool.

Figure 4:
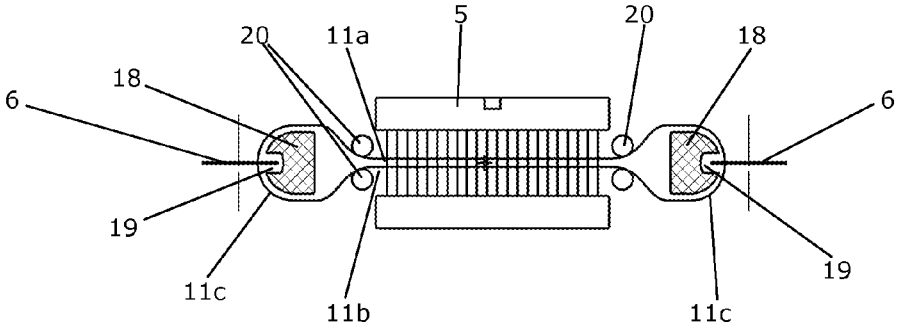

FIG. 4 illustrates the step of stitching centre sections of the upper weft portion 11*a* and the lower weft portion 11*b* together, and the step of cutting side portions 11*c* of the weft 11. In order to force the upper weft portion 11*a* and the lower weft portion 11*b* together for the purpose of facilitating the stitching, a set of compacter bars 20 are arranged on either side of the centre section. The stitching step is performed by means of the first stitching unit 5. The cutting step is performed by means of two cutting units 6 comprising rotating knives or saws. The rotating knives or saws 6 are received in the grooves 19 of the chain heads 18, and this makes it possible to cut the side portions 11*c* of the weft 11 without damaging the knives 6 and/or the chain heads 18.

Figure 5:
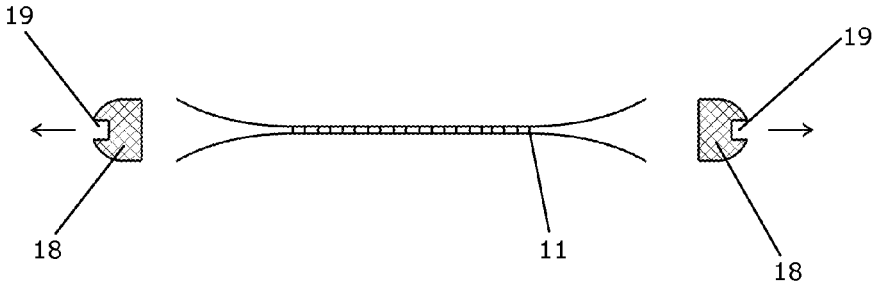

FIG. 5 illustrates the weft 11 which is stitched at the centre section and cut at the side portions 11*c*. The weft 11 has been released from the conveyor portions 4*a*, i.e. the chain heads 18 have moved sideways away from the weft 11.

Figure 6:
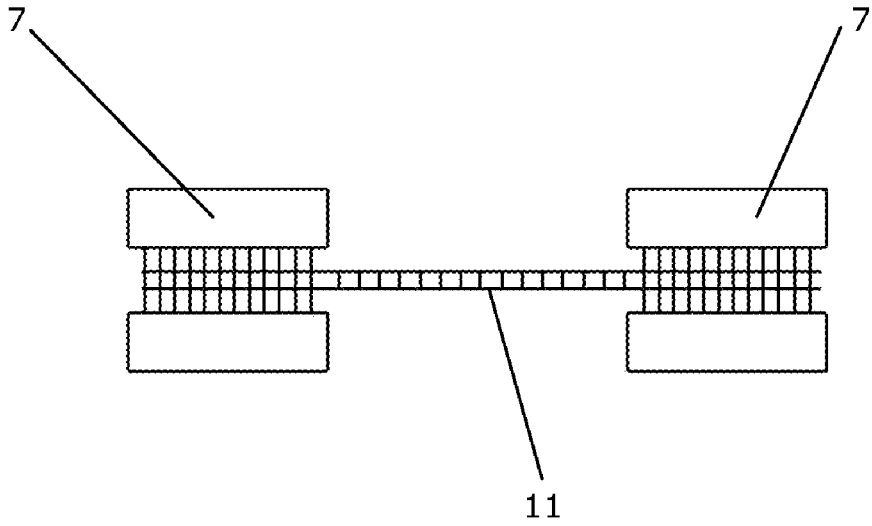

FIG. 6 illustrates the step of stitching rim portions of the weft 11 by means of two additional stitching units 7.

Figure 7:
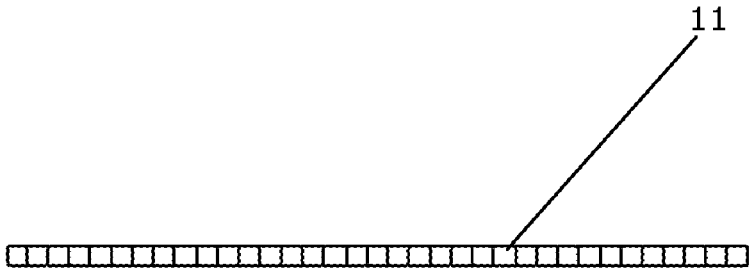

FIG. 7 shows the final product in the form of a weft 11 which is stitched in its entire width.

Figure 8:
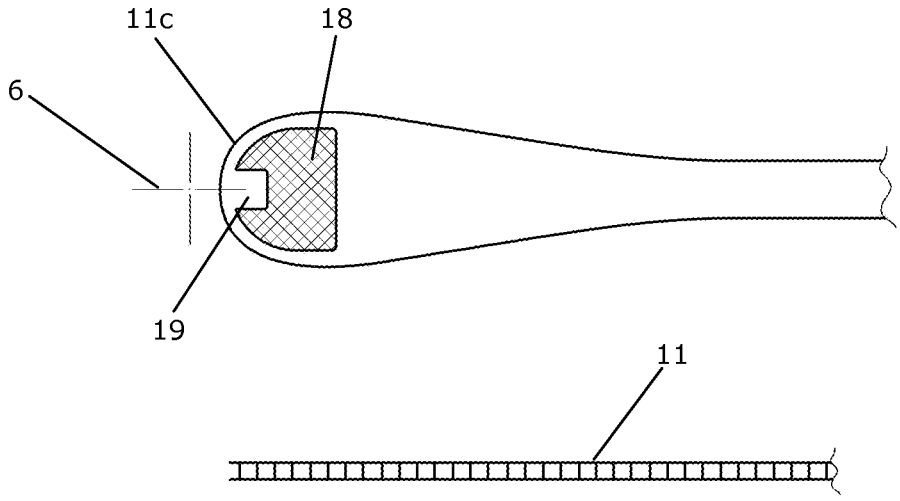
FIG. 8 illustrates a cutting step of a method according to an embodiment of the invention.
Figure 9:
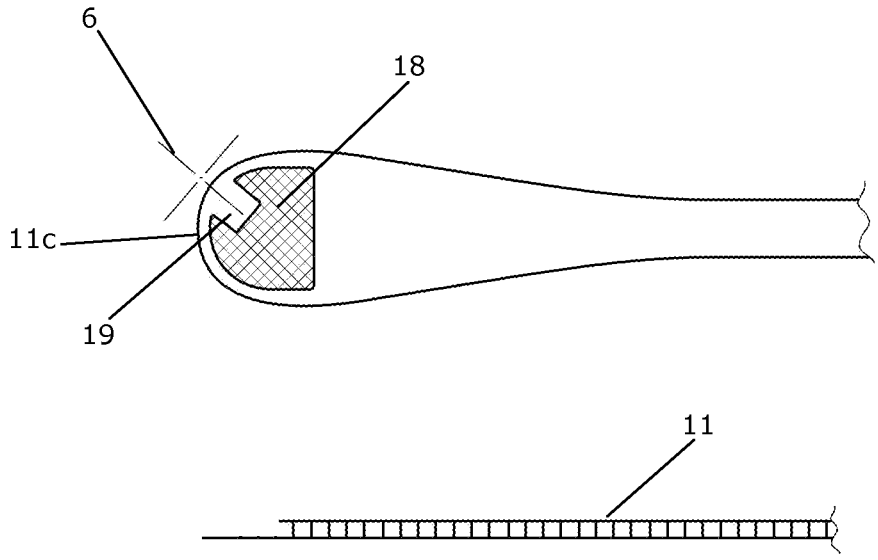
FIG. 9 illustrates a cutting step of a method according to an alternative embodiment of the invention.

FIGS. 8 and 9 illustrate the step of cutting side portions 11*c* of the weft according to two different embodiments of the invention.

In FIG. 8 the groove 19 of the chain head 18 is arranged substantially in the middle of the chain head 18, and the cutting unit 6 cuts along a substantially horizontal direction. As a consequence, the width of the upper weft portion 11*a* and the width of the lower weft portion 11*b* after the cutting step are substantially identical. The result is illustrated in the lower part of FIG. 8, i.e. a double layer of weft material is present at the edge of the finished weft 11.

In FIG. 9 the groove 19 of the chain head 18 is arranged in an upper part of the chain head 18, and the cutting unit 6 cuts along an inclined direction. As a consequence, the lower weft portion 11*b* is wider than the upper weft portion 11*a* after the cutting step has been performed. The result is illustrated in the lower part of FIG. 9, i.e. only a single layer of weft material is present at the edge of the finished weft 11. As described above, this has the advantage that a smoother edge of the weft is obtained, hence the stress concentration at the edge of the weft is reduced.

Figure 10:
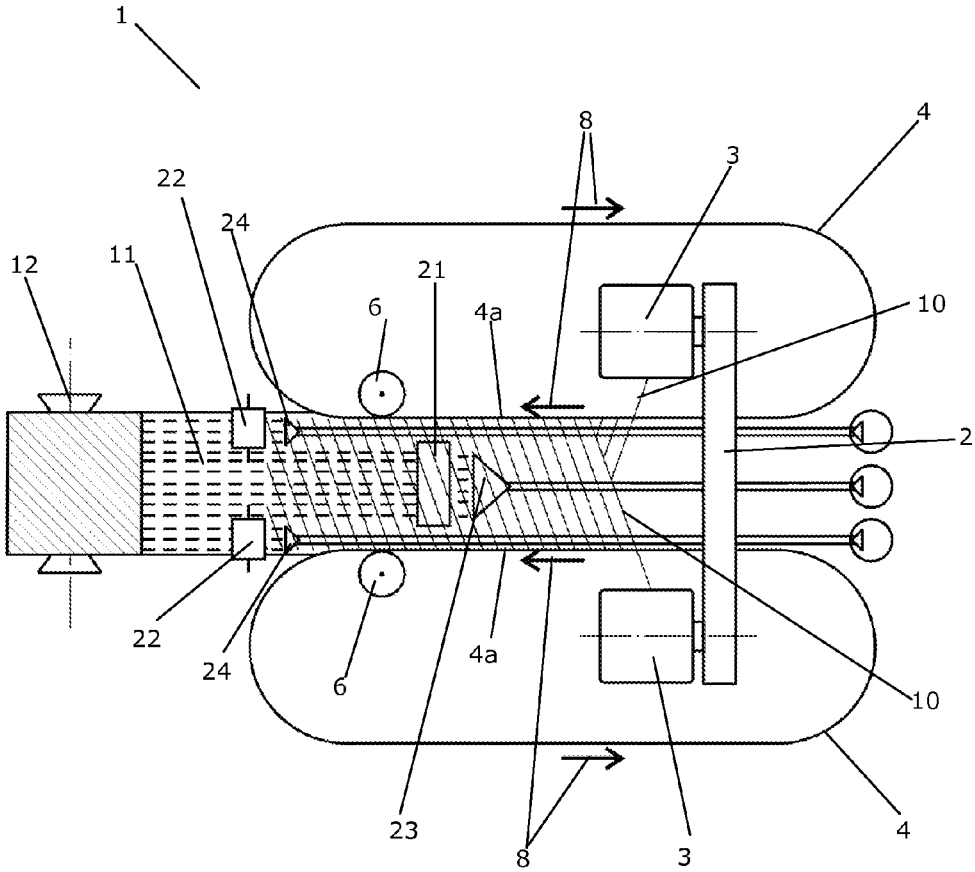
FIG. 10 is a schematic view from above of an apparatus according to a second embodiment of the invention.

FIG. 10 is a schematic view from above of an apparatus 1 according to a second embodiment of the invention. The apparatus 1 comprises a yarn spool holder 2 carrying a number of yarn spools 3, two of which are visible. The yarn spool holder 2 is arranged in such a manner that it is capable of rotating about substantially parallelly arranged portions 4*a* of two endless conveyors 4.

The apparatus 1 further comprises a first resin applying unit 23, a first pressing unit 21, two cutting units 6, two additional resin applying units 24 and two additional pressing units 22.

The conveyors 4 are movable along a conveying direction indicated by arrows 8. When the yarn spool holder 2 is rotated about a rotational axis arranged in the longitudinal direction of the conveyors 4, and the conveyors 4 are simultaneously moved along the conveying direction 8, yarn 10 from the yarn spools 3 is arranged helically about the conveyor portions 4*a*. The pitch of the helix defined by each yarn 10 is determined by the rotational speed of the yarn spool holder 2 and the conveying speed of the conveyors 4. Yarn 10 arranged on the upper side of the apparatus 1 is arranged at an angle, θ, with respect to the conveying direction 8, and yarn 10 arranged on the lower side of the apparatus 1 is arranged at an angle, −θ, with respect to the conveying direction 8. The angle, θ, is determined by the pitch of the helix and thereby by the rotating speed of the yarn spool holder 2 and the conveying speed of the conveyors 4.

Thus, the yarn 10 is arranged about the conveyor portions 4*a* in such a manner that a weft 11 is formed, the weft 11 having a first, upper, weft portion having yarns 10 arranged at an angle, θ, with respect to the conveying direction 8, and a second, lower, weft portion having yarns 10 arranged at an angle, −θ, with respect to the conveying direction 8.

The weft 11 is advanced along the conveying direction 8 by the conveyors 4 towards the first resin applying unit 23. Here resin is applied in a region between a centre section of the upper weft portion and a centre section of the lower weft portion, e.g. by means of an extrusion process. The applied resin may advantageously be sufficiently liquid to allow it to permeate into at least the lower weft portion due to gravity and/or capillary forces. Thereby the centre section of at least the lower weft portion may be impregnated upon applying the resin by means of the first resin applying unit 23.

The weft 11 is conveyed further onwards in the conveying direction 8 towards the first pressing unit 21. Here the centre section of the upper weft portion and the centre section of the lower weft portion are pressed towards each other, e.g. by means of a double belt press. Thereby the resin which was applied by means of the first resin applying unit 23 is forced into the centre section of the upper weft portion as well as into the centre section of the lower weft portion, and fixating the centre sections of the two weft portions to each other.

The partly fixated weft 11 is advanced further along the conveying direction 8 towards the cutting units 6. The cutting units 6 cut side portions of the weft 11, thereby separating the first weft portion from the second weft portion and forming two weft layers. It should, however, be noted that the two weft layers thereby formed are already fixated relative to each other at the centre section due to the applied resin and the pressing previously performed by the first pressing unit 21.

The cutting of the side portions of the weft 11 further releases the weft 11 from the conveyor portions 4*a*, and the conveyor paths are therefore allowed to return to the position where yarn 10 is being arranged about the conveyor portions 4*a*.

The weft 11 is advanced even further along the conveying direction 8 towards the additional resin applying units 24. Each of the additional resin applying units 24 applies resin in a region between a rim section of the first weft portion and a corresponding rim section of the second weft portion.

The weft 11 is advanced even further along the conveying direction 8 towards the additional pressing units 22, where the rim sections of the weft portions are pressed towards each other. Thereby the weft portions are fixated to each other in the entire width of the weft 11.

Finally, the finished weft 11 is wound onto web winder 12.

It is noted that since the weft 11 is first fixated in a centre section, then cut at the side portions and finally fixated in the rim sections, no material needs to be cut away from the weft 11. Thereby the material used for making the weft 11 is utilised to the greatest possible extent.

It is also noted that the distance between the resin applying units 23, 24 and the corresponding pressing units 21, 22 may be longer than shown in the Figure. A longer distance will allow the resin to permeate into the lower weft portion, thereby impregnating the lower weft portion, prior to pressing the weft portions towards each other.

The yarn spool holder 2 of the apparatus 1 of FIG. 10 is identical to the yarn spool holder 2 of the apparatus 1 of FIG. 1, i.e. the yarn 10 is applied in substantially identical manners in the two embodiments. Accordingly, the description of FIG. 2 given above is also applicable for the apparatus shown in FIG. 10.

FIGS. 11-15 are cross sectional views of the apparatus 1 of FIG. 10 taken at various positions along the conveying direction 8. FIGS. 11-15 illustrate various method step of a method for manufacturing a preform moulding material according to a second embodiment of the invention, the steps being performed at various positions along the conveying direction 8 as described above with reference to FIG. 10.

Figure 11:
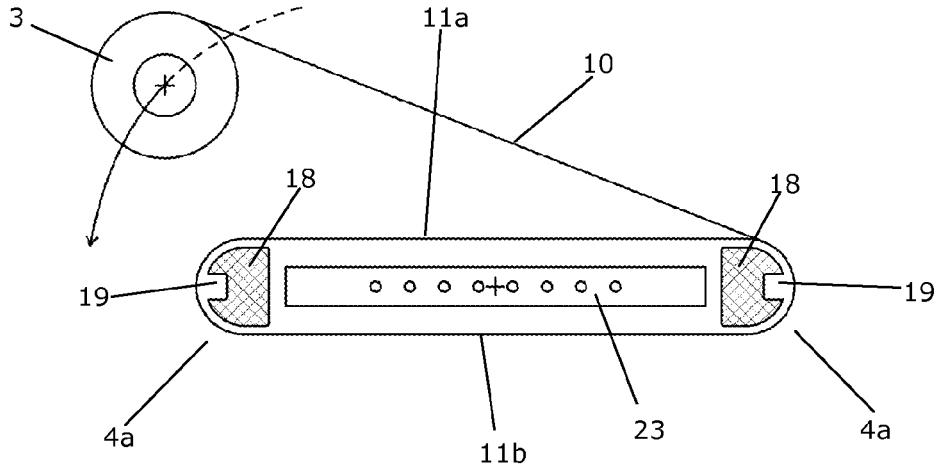
FIGS. 11-15 are cross sectional views of the apparatus of FIG. 10, at various positions along a conveying direction, and illustrating a method according to a second embodiment of the invention.

FIG. 11 illustrates the step of arranging a yarn 10 helically about two conveyor portions 4*a* by rotating a yarn spool 3 about the two conveyor portions 4*a*, thereby forming an upper weft portion 11*a* and a lower weft portion 11*b*, and the step of applying resin in a region between the weft portions 11*a*, 11*b* by means of resin applying unit 23. In FIG. 11 the conveyor portions 4*a* form part of a chain conveyor comprising a plurality of chain heads 18. Each of the chain heads 18 is provided with a groove 19 adapted to receive a cutting tool.

Figure 12:
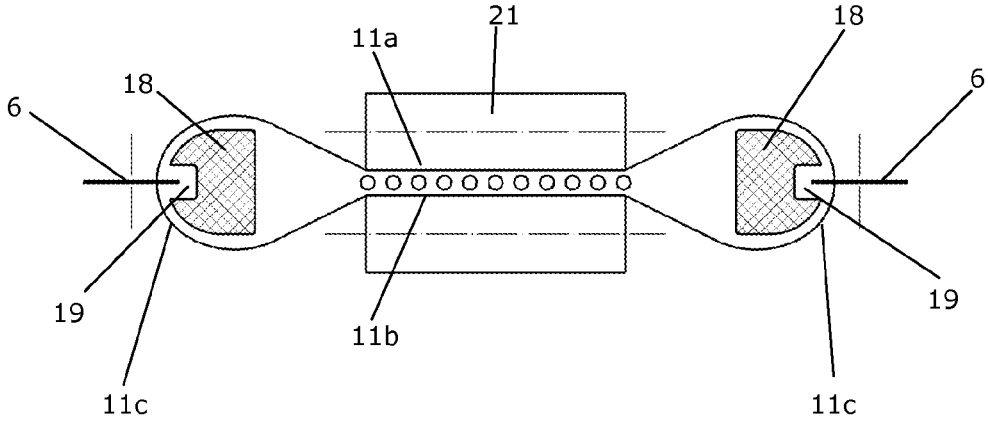

FIG. 12 illustrates the step of pressing centre sections of the upper weft portion 11*a* and the lower weft portion 11*b* towards each other by means of first pressing unit 21, and the step of cutting side portions 11*c* of the weft 11. The pressing step is performed by means of the first pressing unit 21. The cutting step is performed by means of two cutting units 6 comprising rotating knives or saws. The rotating knives or saws 6 are received in the grooves 19 of the chain heads 18, and this makes it possible to cut the side portions 11*c* of the weft 11 without damaging the knives 6 and/or the chain heads 18.

Figure 13:
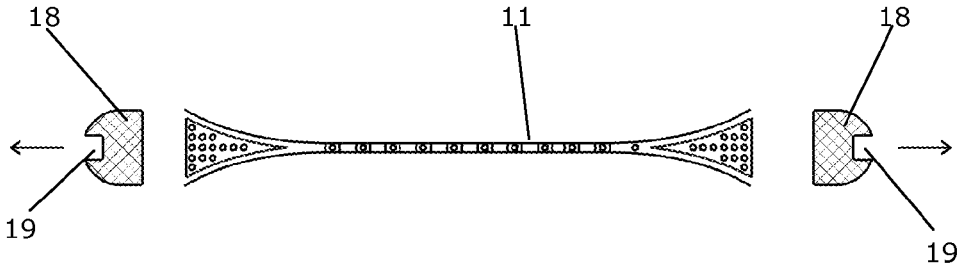

FIG. 13 illustrates the weft 11 which is fixated at the centre section and cut at the side portions 11*c*. The weft 11 has been released from the conveyor portions 4*a*, i.e. the chain heads 18 have moved sideways away from the weft 11. Furthermore, resin has been applied in regions between the rim sections of the weft portions 11*a*, 11*b*.

Figure 14:
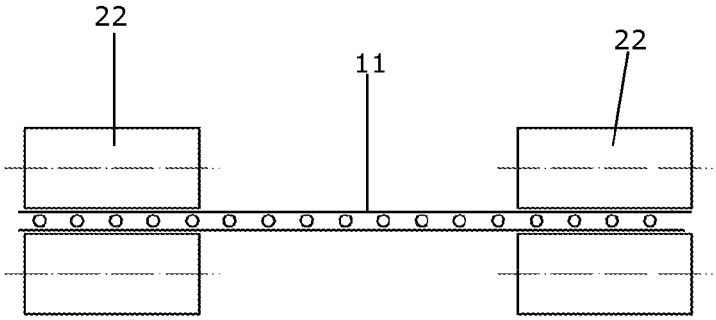

FIG. 14 illustrates the step of pressing rim sections of the weft 11 by means of two additional pressing units 22.

Figure 15:
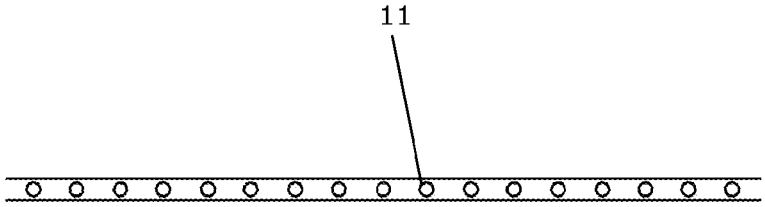

FIG. 15 shows the final product in the form of a weft 11 which is fixated in its entire width.

The invention claimed is:

1. A method for producing a multiaxial fabric, the method comprising:

arranging at least one yarn helically about at least two conveyor portions, thereby providing a weft having a first weft portion having yarns arranged at an angle, θ, with respect to the conveying direction of the conveyor portions, and a second weft portion having yarns arranged at an angle, −θ, with respect to the conveying direction of the conveyor portions, fixing a centre section of the first weft portion to a centre section of the second weft portion, cutting side portions of the weft, thereby separating the first weft portion from the second weft portion, and fixing rim sections of the first weft portion to rim sections of the second weft portion, wherein the step of cutting side portions of the weft is performed after the step of fixing a centre section of the first weft portion to a centre section of the second weft portion, and before the step of fixing rim sections of the first weft portion to rim sections of the second weft portion.

2. The method according to claim 1, wherein the step of arranging at least one yarn comprises simultaneously arranging at least two yarns helically about the at least two conveyor portions.

3. The method according to claim 1, wherein the step of arranging at least one yarn comprises rotating a yarn spool holder carrying at least one yarn spool about the conveyor portions.

4. The method according to claim 1, wherein the step of fixing a centre section of the first weft portion to a centre section of the second weft portion comprises the step of stitching the centre sections together.

5. The method according to claim 1, wherein the step of fixing a centre section of the first weft portion to a centre section of the second weft portion is performed by bonding.

6. The method according to claim 1, wherein the step of fixing a centre section of the first weft portion to a centre section of the second weft portion comprises:

applying resin onto at least one of a centre section of the first weft portion and a centre section of the second weft portion, and pressing the centre section of the first weft portion and the centre section of the second weft portion towards each other.

7. The method according to claim 6, wherein the step of applying resin onto at least one of a centre section of the first weft portion and a centre section of the second weft portion comprises applying resin in a region between the centre section of the first weft portion and the centre section of the second weft portion.

8. The method according to claim 1, wherein the step of fixing rim sections of the first weft portion to rim sections of the second weft portion comprises the step of stitching the rim portions together.

9. The method according to claim 1, wherein the step of fixing the rim sections of the first weft portion to rim sections of the second weft portion comprises:

applying resin onto at least one of rim sections of the first weft portion and rim sections of the second weft portion, and pressing the rim sections of the first weft portion and the rim sections of the second weft portion towards each other.

10. The method according to claim 9, wherein the step of applying resin onto at least one of rim sections of the first weft portion an rim sections of the second weft portion comprises applying resin in regions between rim sections of the first weft portion and rim sections of the second weft portion.

11. The method according to claim 1, wherein the step of cutting side portions of the weft is performed in such a manner that the separated first and second weft portions obtain substantially equal width.

12. The method according to claim 1, wherein the step of cutting side portions of the weft is performed in such a manner that the first weft portion obtains a width which is smaller than a width obtained by the second weft portion, or in such a manner that the second weft portion obtains a width which is smaller than a width of the first weft portion.

13. The method according to claim 1, further comprising arranging at least one additional yarn substantially along the conveying direction of the conveyor portions, thereby providing at least one warp portion.

14. An apparatus for producing a multiaxial fabric, the apparatus comprising:

at least two conveyor portions defining a conveying direction, at least one yarn spool adapted to supply yarn helically about said conveyor portions, in order to provide a weft having a first weft portion having yarns arranged at an angle, θ, with respect to the conveying direction of the conveyor portions, and a second weft portion having yarns arranged at an angle, −θ, with respect to the conveying direction of the conveyor portions, a first fixing unit arranged to fixate a centre section of the first weft portion to a centre section of the second weft portion, at least one cutting unit arranged to cut side portions of the weft in order to separate the first weft portion from the second weft portion, and at least one additional fixing unit arranged to fixate rim sections of the first weft portion to rim sections of the second weft portion, wherein the first fixing unit, the at least one cutting unit, and the at least one additional fixing unit are arranged such that the at least one cutting unit cuts the side portions of the weft after the first fixing unit fixes the centre section of the first weft portion to the centre section of the second weft portion, and before the at least one additional fixing unit fixes the rim sections of the first weft portion to the rim sections of the second weft portion.

15. The apparatus according to claim 14, said apparatus comprising at least two yarn spools adapted to simultaneously supply yarn helically about said conveyor portions.

16. The apparatus according to claim 14, wherein the at least one yarn spool is mounted on a spool holder, the spool holder and the conveyor portions being adapted to perform relative rotational movements.

17. The apparatus according to claim 14, wherein at least one of the first fixing unit and the at least one additional fixing unit comprises one or more stitching units.

18. The apparatus according to claim 14, wherein at least one of the first fixing unit and the at least one additional fixing unit comprises one or more resin applying units and one or more pressing units.

19. The apparatus according to claim 18, wherein at least one of the resin applying units is adapted to apply resin in a region between the first weft portion and the second weft portion.

20. The apparatus according to claim 14, wherein the conveyor portions are chain conveyors.

* * * * *